United States Patent [19]

Russo et al.

[11] Patent Number: 5,033,558

[45] Date of Patent: Jul. 23, 1991

[54] WELL TOOL FOR USE WITH DOWN-HOLE DRILLING APPARATUS

[75] Inventors: Robert L. Russo, St. Martinsville; Curley J. Vallot, Jr., Youngsville, both of La.

[73] Assignee: R.C.R. Oilfield, Inc., Lafayette, La.

[21] Appl. No.: 165,435

[22] Filed: Feb. 29, 1988

Related U.S. Application Data

[63] Continuation of Ser. No. 70,600, Jul. 9, 1987, abandoned, which is a continuation of Ser. No. 734,954, May 16, 1985, abandoned.

[51] Int. Cl.[5] ..... E21B 17/10

[52] U.S. Cl. ..... 175/325; 175/349

[58] Field of Search ..... 175/92, 95, 325, 349, 175/408, 107; 166/241

[56] References Cited

U.S. PATENT DOCUMENTS

| | | | |
|---|---|---|---|
| 712,488 | 11/1902 | Black | 308/4 A |
| 1,281,756 | 10/1918 | Black | 308/4 A |
| 1,541,791 | 6/1925 | Christofferson | 308/4 A |
| 1,721,004 | 7/1929 | Debose | 308/4 A X |
| 1,788,377 | 1/1931 | Bishop | 175/325 X |
| 2,151,646 | 3/1939 | Subkow et al. | 175/325 |
| 2,466,239 | 4/1949 | Holcombe | 308/4 A X |
| 2,877,988 | 3/1959 | Cameron et al. | 175/349 X |
| 3,338,321 | 8/1967 | Pomeroy | 175/92 |
| 4,547,833 | 10/1985 | Sharp | 175/325 X |
| 4,612,987 | 9/1986 | Cheek | 175/325 X |

*Primary Examiner*—William P. Neuder

*Attorney, Agent, or Firm*—Browning, Bushman, Anderson & Brookhart

[57] ABSTRACT

A well tool for use in a down-hole drilling assembly wherein the drill bit is rotated without drill pipe rotation comprising a generally tubular body and a plurality of roller assemblies secured to the body, the roller assemblies including rollers which rotate around axes generally transverse to an axis passing lengthwise through the body of the well tool.

3 Claims, 2 Drawing Sheets

WELL TOOL FOR USE WITH DOWN-HOLE DRILLING APPARATUS

This is a continuation of co-pending application Ser. No. 070,600 filed on July 9, 1987, now abandoned, which is a continuation of application Ser. No. 734,954 filed May 16, 1985, now abandoned.

BACKGROUND OF THE INVENTION

The present invention relates to a well tool for use in a down-hole drilling assembly. More particularly, the present invention relates to a well tool for centralizing a bottom-hole assembly in a down-hole drilling apparatus wherein the drill bit is rotated without drill pipe rotation.

In directional drilling operations where it is desired that the borehole be deviated or drilled off vertical, it is common to use down-hole drilling machines or apparatus in which the drill bit is rotated to effect the drilling operation without rotation of the drill pipe. For example, one type of such down-hole drilling apparatus employs a positive displacement, down-hole mud motor which rotates the drill bit and a rotatable drill bit sub. In a deviated hole, it is not uncommon that the bottom-hole assembly, i.e. the assembly nearest the down-hole mud motor, will stick to the wall of what is commonly referred to as the "low side" of the hole. It will be appreciated that in deep, deviated well bores, there is a large weight of drill pipe providing a large, vertically downward vector of force on the drill string. The situation can be particularly acute in cases where there is a large deviation off vertical, i.e. where the well bore is deviated to a near horizontal path. In such cases, since the drill string is not rotating, and depending upon the formation encountered, because of the downward force the drill string will stick on the low side of the dog leg or curvature adjoining the generally vertical part of the borehole with the generally horizontal tending part of the borehole. When such wall sticking occurs, drilling progress is essentially stopped since the drill string is prevented from any further movement axially along the well bore.

To overcome this wall sticking problem, it is common to condition the drilling mud to break the sticking or suction between the wall of the well bore formation and the drill string. Thus, gellants and other additives which act as lubricants are added to the mud in an attempt to decrease the friction between the well bore formation and the drill string and allow the latter to slide down the deviated hole. Other techniques involve the addition to the mud of solid materials such as walnut hulls, rice hulls, etc. which are pumped down the hole and which act as bearings so as to allow the bottom-hole assembly to slide in the deviated hole. These techniques are unsatisfactory as they are expensive and time consuming. Additionally, because the conditioning of the mud and freeing of the stuck drill string is so time consuming, it frequently happens that by the time the bottom-hole assembly has been freed, it is necessary to trip the string to replace the drill bit, meaning that the mud conditioning procedure may have to be repeated after a new bit has been attached to the drill string and sent downhole.

SUMMARY OF THE INVENTION

It is therefore an object of the present invention to provide a well tool for use with down-hole drilling apparatus.

Another object of the present invention is to provide a well tool which can be used in deviated or directional drilling operations where downhole drilling apparatus are employed.

A further object of the present invention is to provide a well tool for use in downhole drilling operations which prevents wall sticking of the bottom-hole assembly.

The above and other objects of the present invention will become apparent from the drawings, the description given herein and the appended claims.

The well tool of the present invention, as noted above, is for use with a downhole drilling apparatus, e.g. an apparatus which effects the drilling of a borehole without conventional drill pipe rotation using a rotary table or the like. The well tool has a body with an outer surface, a first end and a second end, the body adapted to be connected, generally by means of threaded connections, in the drill string. There is at least one roller means mounted on the body, the roller means being mounted for rotation about an axis which is generally transverse to an axis passing through the first and second ends of the body. Preferably, there are a plurality of such roller means disposed circumferentially around the body.

BRIEF DESCRIPTION OF THE DRAWINGS

In the following description, wherein like numbers are used to identify like parts.

DESCRIPTION OF THE PREFERRED EMBODIMENT

Figure 1:
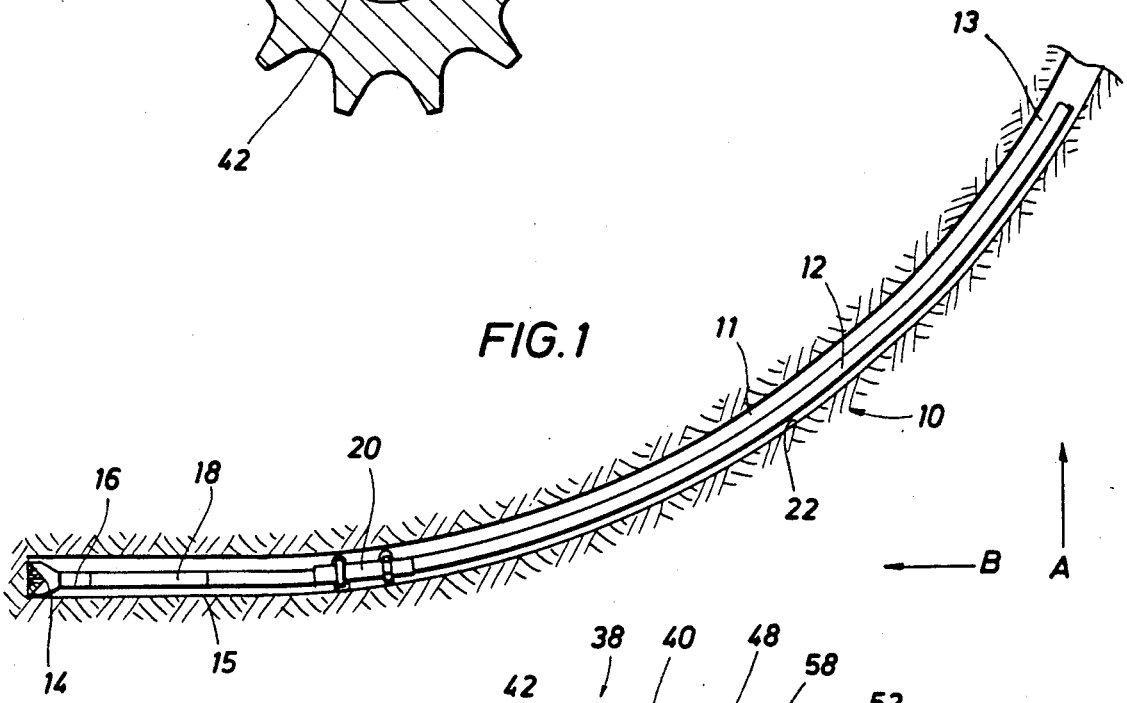
FIG. 1 is an elevational view, partly in section, showing the well tool of the present invention in a drill string in a deviated well bore.

Referring first to FIG. 1, there is shown a deviated well bore 10 having a dog leg or curvature 11 adjoining a generally vertical section 13 of the well bore 10 with the horizontally tending section 15 of the well bore 10, the arrow A representing generally the vertical direction, the arrow B representing generally the horizontal direction. For clarity, the curvature of the dog leg 10 is exaggerated, it being understood that directionally drilled wells can have portions varying from near horizontal relative to vertical to only a few degrees off vertical. A non-rotating drill string 12 extends downwardly from a drill rig (not shown) and includes a bottom-hole assembly comprising a drill bit 14, a rotating drill sub 16 and a downhole motor 18. The bottom-hole assembly also includes the well tool or centralizer 20 of the present invention as well as various subs, drill collars, etc. In conventional directional drilling wherein down-hole drilling apparatus is employed, and in a deviated well such as depicted in FIG. 1, there is a tendency for the drill string 12 to lay against the low side 22 of the well bore 10. Depending on depth of the well, the type of formation, the speed of drilling and other such parameters, drill string 12 can stick to the wall of the low side 22 thereby impeding the drilling operation. However, with the presence of the well tool or centralizer 20, as can be seen, drill string 12 is held away from low side 22, i.e. it is centralized in well bore 10.

Figure 3:
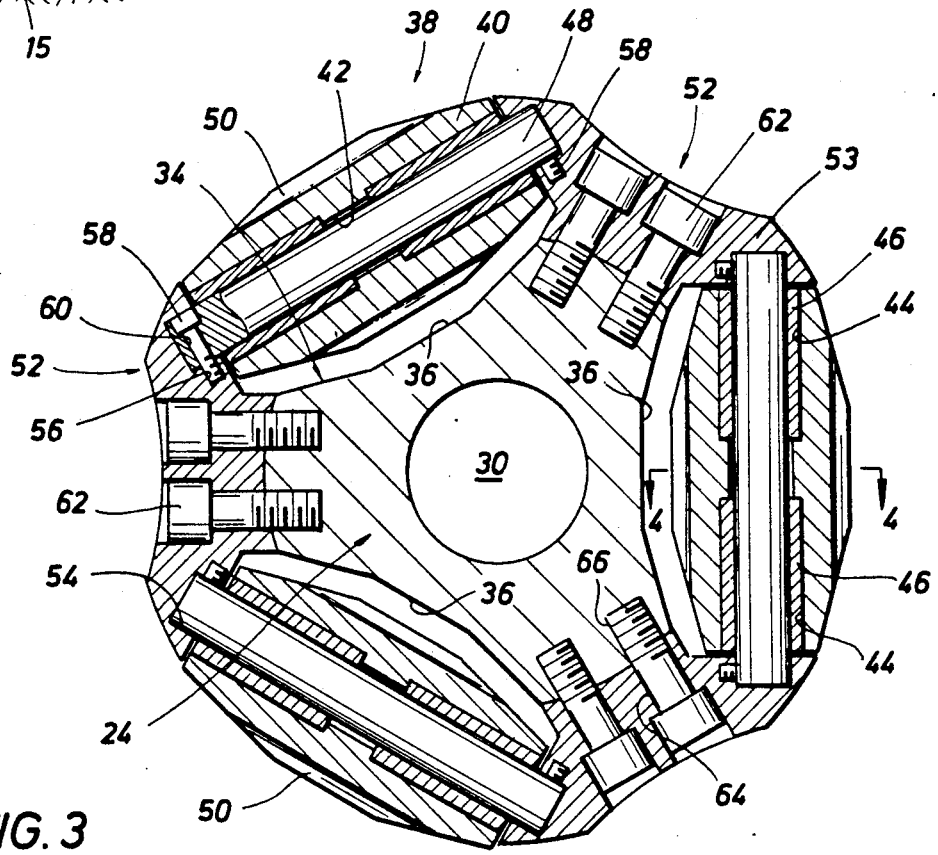
FIG. 3 is a cross-sectional view taken along the line 3—3 of FIG. 2.
Figure 2:
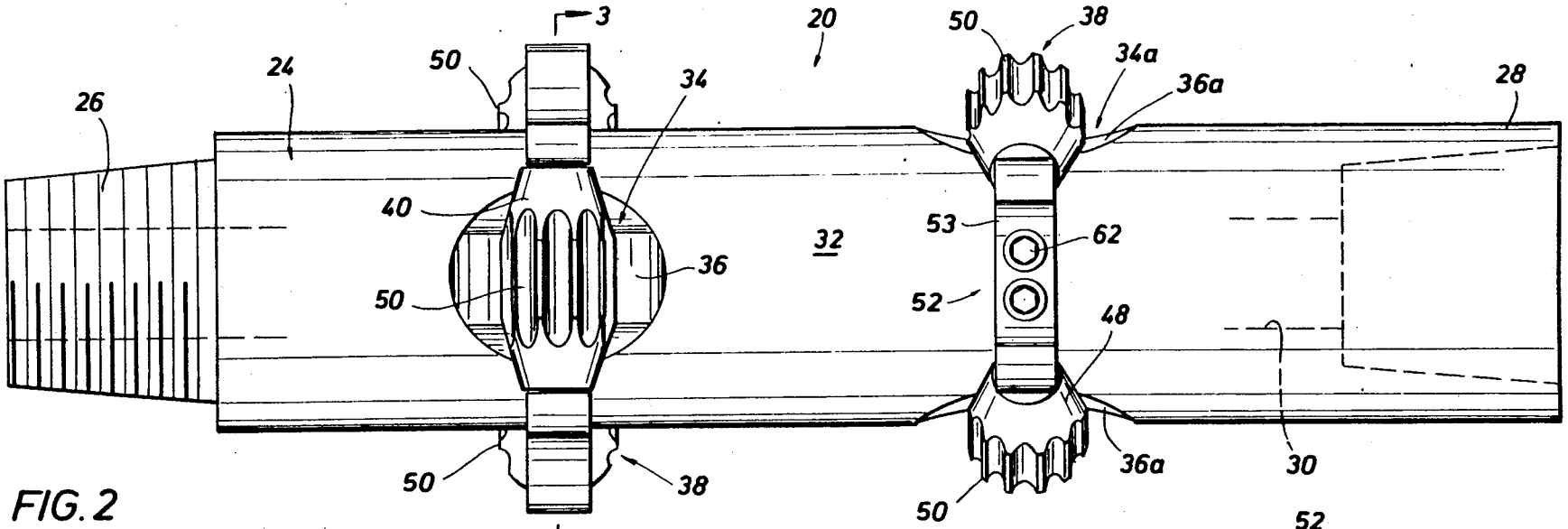
FIG. 2 is a side, elevational view of the well tool of the present invention.

Referring now to FIGS. 2 and 3, the well tool 20 of the present invention is seen to comprise a generally tubular body 24 having a first end 26 which forms a threaded pin and a second end 28 which forms a complementary threaded box 28. Pin and box connections 26 and 28, respectively, permit the well tool to be attached in the drill string. It will be understood that body 24 can be provided with double pin connections or double box connections and that various subs can be used to connect the body 24 into the well string. Body 24 also has a longitudinally-extending bore 30 through which drilling mud flows when the body 24 is connected into the well string.

While body 24 is generally circular, when viewed in transverse cross section, the outer surface 32 is provided with a first necked down portion, shown generally as 34. Necked down portion 34 defines three generally equally, circumferentially spaced recesses 36, i.e. approximately 120° apart. Partially received in each of the three recesses 36 is a roller assembly, shown generally as 38. Each of the roller assemblies 38 includes a body 40 having a bore 42 extending therethrough. Received in counterbored portions 44 of bore 42 are press-fitted bearings or bushings 46. Extending through bore 42 and serving to rotatably journal body 40 of roller assembly 38 is a shaft 48. Roller assembly 38 also includes a plurality of teeth 50 which extend circumferentially around body 40 and are aligned generally axially with shaft 48.

As can best be seen with reference to FIG. 3, each of the first set of three roller assemblies 38 is mounted on body 24 by means of three pillow block assemblies 52, each pillow block assembly 52 serving to non-rotatably mount the adjacent ends of adjacent shafts 48. Thus, each pair of pillow block assemblies 52 provides a complete mounting assembly for one shaft 48 permitting rotation of a roller 40 around an axis generally transverse to the long axis of tool 20, i.e. the axis passing through ends 26 and 28, and one end of each of the remaining two shafts 48.

Each pillow block assembly 52 includes a body 53 having two bores 54, each bore adapted to receive an end of a shaft 48. Body 53 of pillow block assemblies 52 also contain cross bores 56 which are generally perpendicular to bores 54 and are tapped to threadedly receive a socket head bolt 58 which extends through a bore 60 in shaft 48 to thereby fixedly secure one end of shaft 48 to body 53 of pillow block assembly 52. In like manner, the other end of shaft 48 is secured to the body 53 of the adjacent pillow block assembly 52.

Pillow block assemblies 52 are removably secured to body 24 by means of socket head bolts 62 which extend through bores 64 in pillow block bodies 53 and are received in tapped bores 66 in the body 24.

As best seen with reference to FIG. 2, body 24 is provided with a second necked down portion 34*a*, similar to necked down portion 34, and having recesses 36*a* for receiving a second set of three roller assemblies 38. Necked down portion 34*a* is axially displaced from necked down portion 34, recesses 36*a* being circumferentially displaced relative to recesses 36 by approximately 60°. Roller assemblies 38 are secured to body 24 in necked down portion 34*a* in the same manner that roller assemblies 38 are secured to body 24 in necked down portion 34 and are also generally equally, circumferentially disposed, i.e. at approximately 120° intervals, around the circumference of body 24.

The roller assemblies 38 secured to body 24 in necked down portion 34 are mounted such that the axes of rotation of the rollers 40 are generally coplanar. Likewise, the roller assemblies 38 secured to body 24 in necked down portion 34*a* are mounted such that the axes of rotation of the rollers 40 are generally coplanar. Since the set of roller assemblies 38 in necked down portion 34*a* are offset circumferentially with respect to the set of roller assemblies 38 in necked down portion 34, there is effectively a roller assembly 38 approximately every 60° around the circumference of body 24 of well tool 20. It is to be understood that it is not necessary that the rollers 40 in any one set, e.g. the rollers 40 in necked down portion 34*a* be mounted so as to have their axes of rotation substantially coplanar. Thus, it is possible that the roller assemblies 38 of a set be staggered axially from one another while still maintaining a circumferential displacement from one another of 120°. Moreover, it is not necessary that there be two sets of three rollers each or that any set contain three rollers. It will be appreciated that in some cases a single roller, properly oriented on body 24, will suffice. It is also within the scope of the invention that the roller assemblies, e.g. the set of rollers secured to body 24 in necked down portion 34, be on a sleeve which is rotatable relative to body 24 so that the rollers can accommodate and position themselves in response to any lateral movement of the well string 12.

Figure 4:
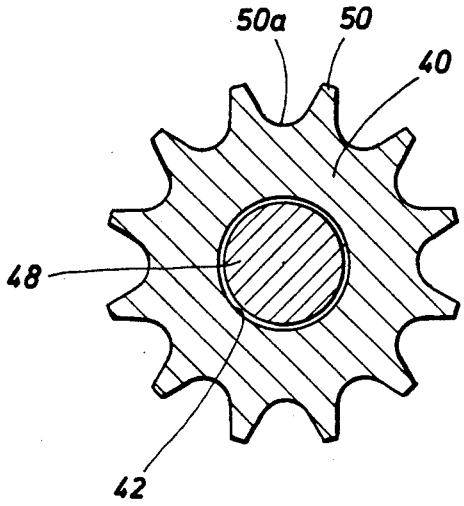
FIG. 4 is a cross-sectional view taken along the lines 4—4 of FIG. 3.

With particular reference to FIG. 4, it can be seen that rollers 40, when viewed in transverse cross section, have a series of circumferentially spaced teeth defining a plurality of circumferentially spaced troughs 50*a* therebetween. Teeth 50 serve to minimize the contact of the rollers 40 with the wall of the well bore and thereby decrease the frictional forces between the drill string and the well bore, while troughs 50*a* provide courses through which the drilling mud can flow to provide lubrication thereby ensuring that the drill string is impeded from sticking to the wall of the well bore. Troughs 50*a* also permit rice hulls, walnut hulls and similar bearing like materials to be easily displaced between tool 20 and the wall of the well bore thereby further enhancing the non-sticking qualities of the well tool. It will be apparent that rollers having other shapes and types of radially outwardly projections can also be employed.

Figure 5:
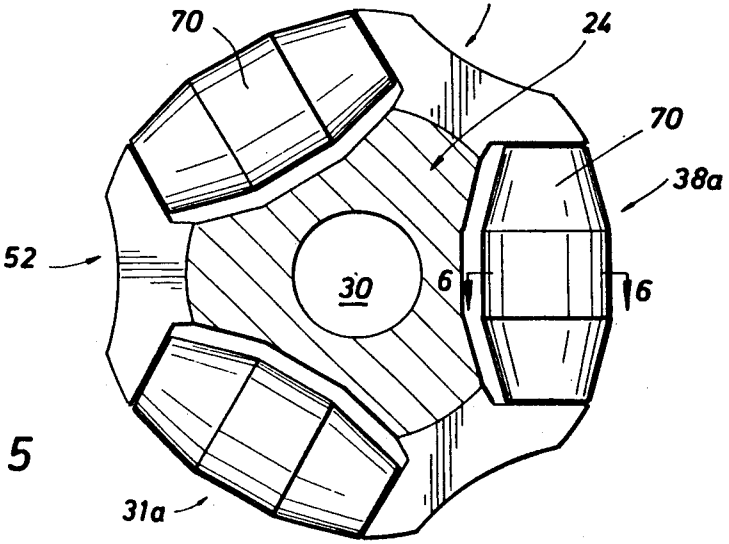
FIG. 5 is a view similar to FIG. 3 showing a different embodiment of the well tool of the present invention.
Figure 6:
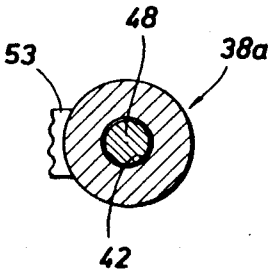
FIG. 6 is a cross-sectional view taken along the line 6—6 of FIG. 5.

With reference to FIG. 5, there is shown a slightly modified embodiment of the present invention wherein the rollers 38*a*, rather than having the toothed configuration described with respect to roller 38, have a generally smooth outer surface 70. Rollers 38*a* having the smooth surface 70 may be preferable in certain formations wherein there is a less of a tendency for the drill string to stick on the low side and consequently less of a need to provide mud circulation between the roller assemblies and the wall of the well bore.

While in the embodiment described above there is depicted the use of a single well tool or centralizer 20 in a bottom-hole assembly utilizing a down-hole drilling apparatus, it will be understood that two or more of such well tools or centralizers can be used if desired. It will also be understood that the precise positioning of the well tool 20 in the bottom-hole assembly will vary depending upon the degree of deviation of the well bore, the number of components in the bottom-hole assembly, etc.

The foregoing disclosure and description of the invention is illustrative and explanatory thereof, and various changes in the size, shape and materials as well as in the details of the illustrated construction may be made within the scope of the appended claims without departing from the spirit of the invention.

What is claimed is:

1. A well tool for use with a down-hole drilling assembly, comprising:

a generally tubular body having a first end, a second end, and a first axis passing through said first and second ends, said body being generally circular in cross section transverse to said first axis;

three roller assemblies mounted in a first plane transverse to said first axis and being equispaced about the periphery of said body; and three roller assemblies mounted in a second plane transverse to said first axis and being equispaced about the periphery of said body, each of the said roller assemblies in said first plane comprising a shaft having its longitudinal axis in the said first plane and having first and second ends each fixedly mounted on said generally circular body, each of said shafts in the said first plane having at least one roller rotatably mounted on said shaft, and each of the said roller assemblies in said second plane comprising a shaft having its longitudinal axis in the said second plane and have first and second ends each fixedly mounted on said generally circular body, each of said shafts in the said second plane having at least one roller rotatably mounted on said shaft, said roller assemblies in said first plane being offset circumferentially with respect to the said roller assemblies in said second plane.

2. The well tool according to claim 1 wherein each of said rollers comprises a roller body having outwardly projecting formations.

3. The well tool according to claim 1 wherein each of said rollers comprises a roller body having a generally smooth surface.

* * * * *